US005695072A

United States Patent [19]

Terragni

[11] Patent Number: 5,695,072

[45] Date of Patent: Dec. 9, 1997

[54] CLOTHES-HANGER DEVICE WITH MOTOR-DRIVEN ELEVATOR MEANS

[75] Inventor: Ezio Terragni, Lentate Sul Seveso, Italy

[73] Assignee: Servetto S.N.C. Di Terragni Ezio & C., Bovisio Masciago, Italy

[21] Appl. No.: 558,497

[22] Filed: Nov. 16, 1995

[30] Foreign Application Priority Data

May 12, 1995 [IT] Italy ..... MI950322 U

[51] Int. Cl.[6] ..... A47F 7/00

[52] U.S. Cl. ..... 211/1.51

[58] Field of Search ..... 211/1.51, 99, 100, 211/163

[56] References Cited

U.S. PATENT DOCUMENTS

| | | | |
|---|---|---|---|
| 2,851,165 | 9/1958 | Schreyer et al. | 211/1.51 |
| 3,315,813 | 4/1967 | Schneider | 211/1.51 |

FOREIGN PATENT DOCUMENTS

| | | | |
|---|---|---|---|
| 0 624 326 | 11/1994 | European Pat. Off. | A47B 61/00 |
| 660218 | 7/1929 | France . | |
| 2 261 156 | 5/1993 | United Kingdom | A47B 61/02 |

*Primary Examiner*—Alvin C. Chin-Shue
*Assistant Examiner*—Sarah L. Purol
*Attorney, Agent, or Firm*—Cushman Darby & Cushman Intellectual Property Group of Pillsbury Madison & Sutro, LLP

[57] ABSTRACT

A clothes-hanger device of the type with upwards/downwards moving elevator means comprises carrier means (11) designed to receive the hung clothes, which carrier means are applied to at least one lever (12) extending from a linkage mechanism means contained inside at least one case (13) fastened onto a carrier surface. In a characteristic way, to said at least one lever (12) a motor unit is applied, thus said clothes-hanger device can be automatically controlled also from a remote control position, without any efforts, to move from a substantially vertical raised position, to a substantially horizontal lowered position.

15 Claims, 9 Drawing Sheets

CLOTHES-HANGER DEVICE WITH MOTOR-DRIVEN ELEVATOR MEANS

The present invention relates to a clothes-hanger device with motor-driven upwards/downwards moving elevator means.

A clothes-hanger device with elevator constituted by a horizontal tube means, designed to receive hung clothes, applied to two carrier levers extending from a suitable linkage mechanism contained inside a case, which is fastened onto the shoulders of a furniture piece, or onto the side walls of a built-in wardrobe, or onto another carrier surface, is known.

The result is an extremely comfortable elevator means which, when installed, e.g., inside the top portion of a wardrobe, moves the hung clothes downwards, and vice-versa.

For that purpose a central rod constrained to the tube is provided to act as a grip means, by means of which the operator can manually operate the clothes-hanging device, in order to lift, as well as lower, said clothes.

The smoothness of movements is secured by equilibrating means cooperating with the above said lever driving linkage mechanisms.

A clothes-hanger device of this type is disclosed, e.g., in Italian patent for industrial invention No. 849,530; and in Italian patent for utility model No. 184,156; and is well-known on the market with the trade mark "SERVETTO", registered under Reg. Nos. 553,123 and 553,124.

The present invention relates to the motor drive of such a manually operated clothes-hanging device by a motor means, which will enable the operator to actuate said clothes-hanger device without any efforts, and also from a remote control site, which is a very useful, and, in some cases, even essential feature, as, e.g., in case of disabled persons.

Such a purpose is accomplished by a clothes-hanger device displaying the characteristics expounded in the appended claims.

The structural and functional features of the present invention, and the advantages offered by it over the prior art will become evident from a study of the following disclosure, made by referring to the accompanying drawings, which display an exemplifying embodiment of a clothes-hanger device incorporating the innovative principles of said invention.

Figure 1:
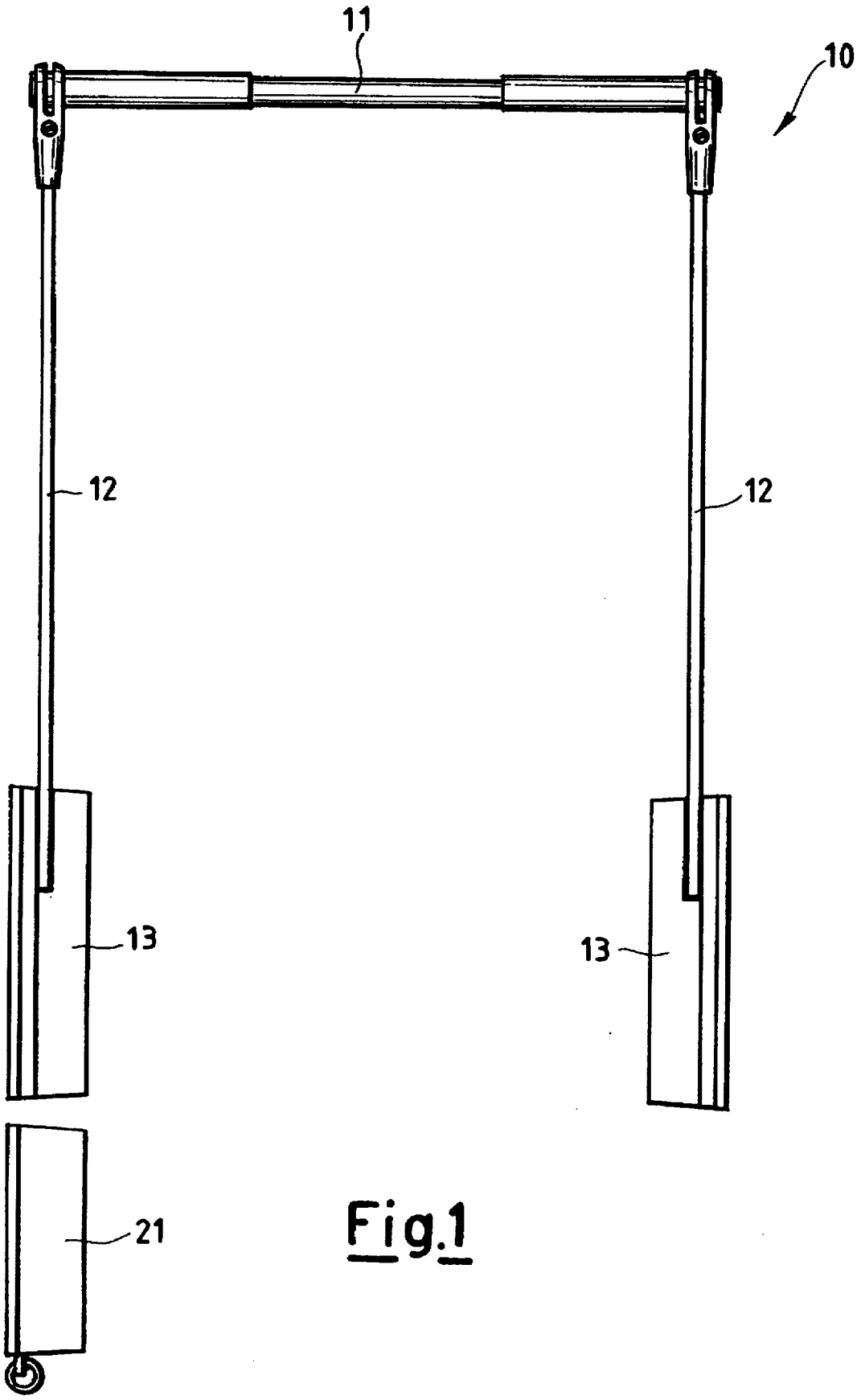
FIG. 1 shows a front elevation view illustrating an exemplifying embodiment of a clothes-hanger device realized according to the present invention.

In FIG. 1 of accompanying drawings, the reference numeral (10) generally indicates an exemplifying embodiment of a clothes-hanger device of the type with upwards/downwards moving elevator, which comprises a horizontal tube means (11) designed to receive the hung clothes, applied to two side carrier levers (12) each extending from a purposely provided linkage mechanism means contained inside a relevant case (13), with each of said cases (13) being fastened onto the shoulders of a piece of furniture, onto the side walls of a built-in wardrobe, or onto any other carrier surface.

According to the present invention, the upwards/downwards movements (i.e., raising/lowering motions) of the clothes-hanger device (10) are advantageously driven by means of a motor unit contained inside each of cases (13) and operatively linked with the relevant lever (12).

Figure 2:
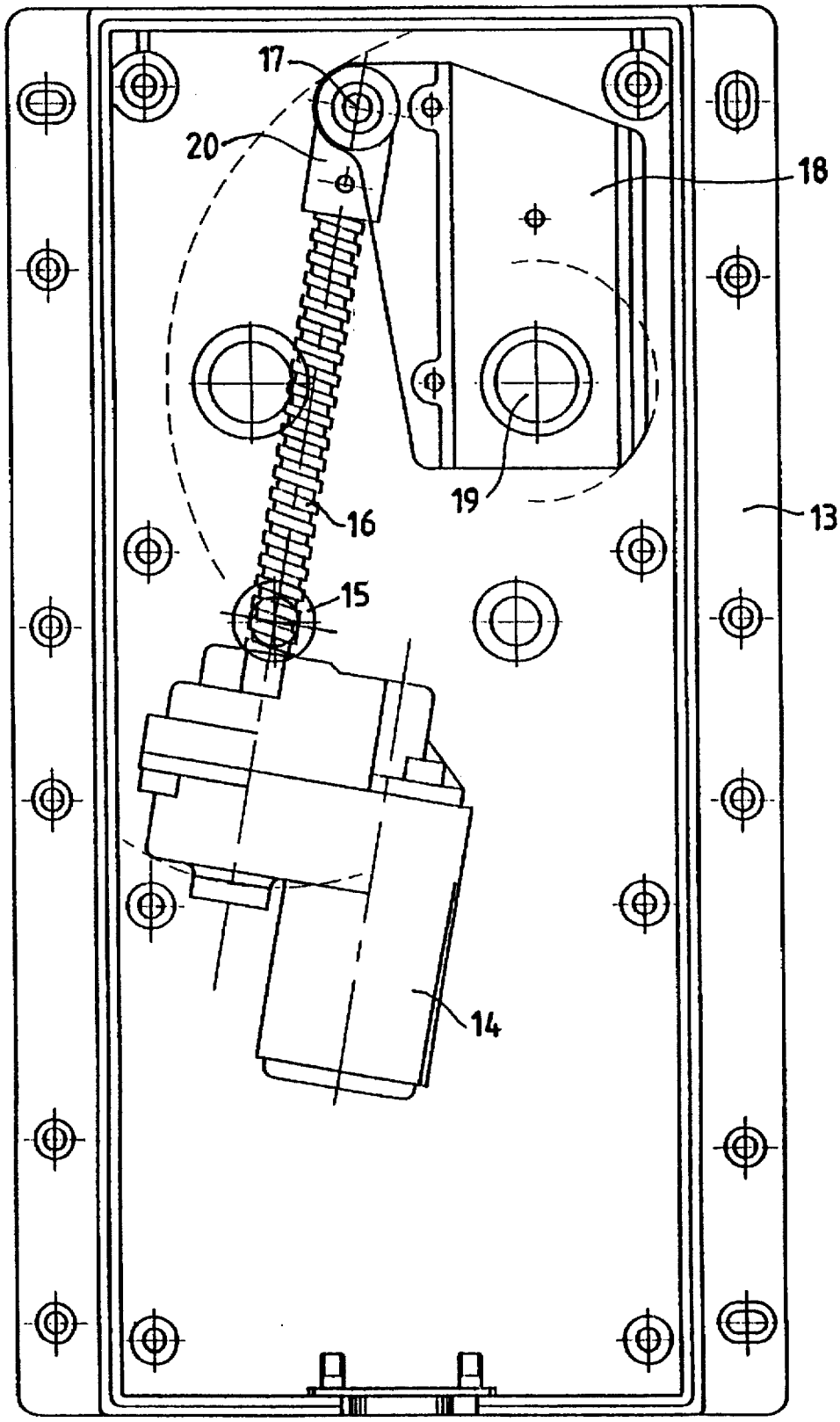
FIG. 2 shows a detail view illustrating the motor unit which drives the device, in its condition corresponding to the clothes-hanger tube means being in its completely raised position.
Figure 3:
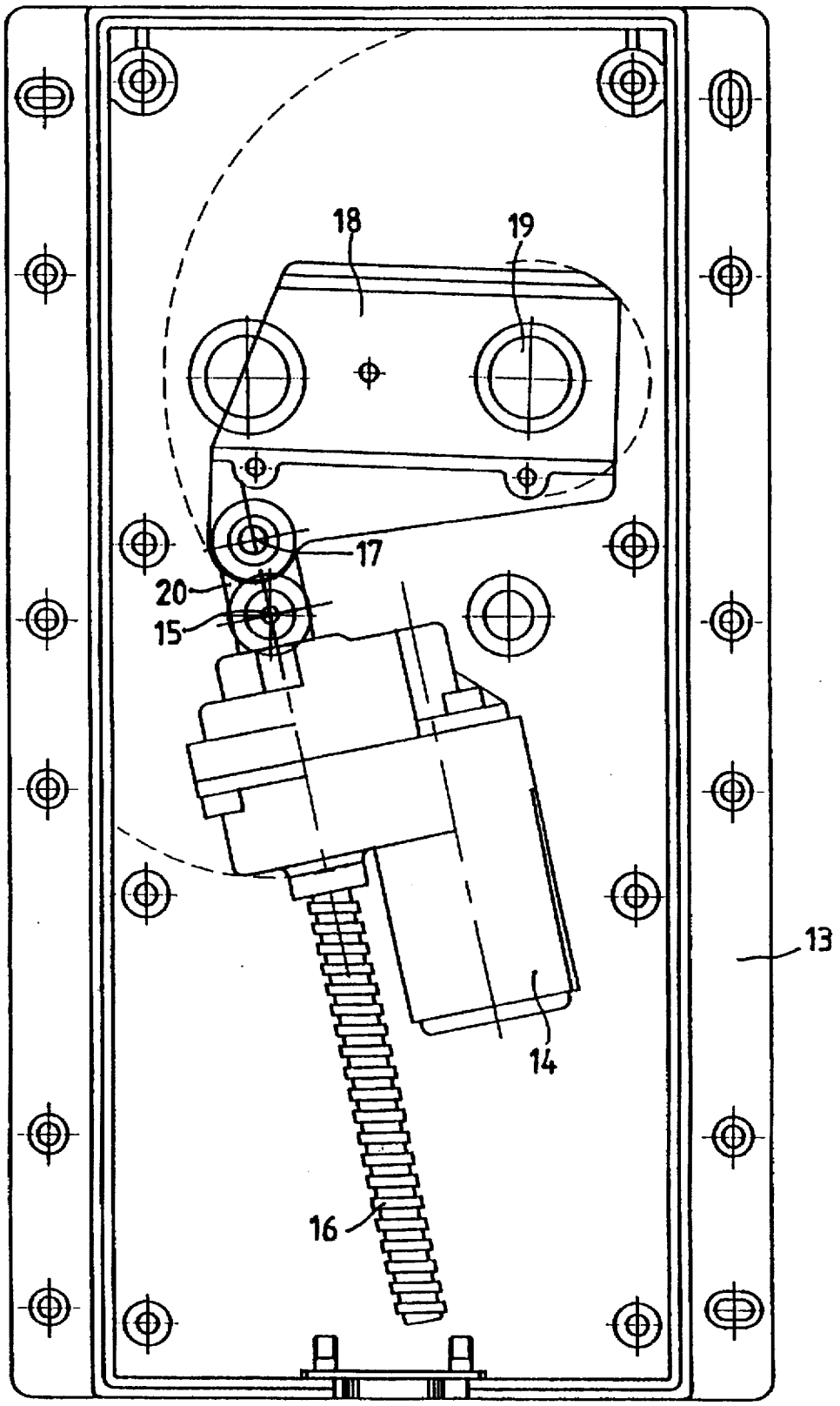
FIG. 3 shows a similar view to FIG. 2, but illustrating the motor unit in its condition corresponding to the completely lowered position of the clothes-hanger tube means.
Figure 4:
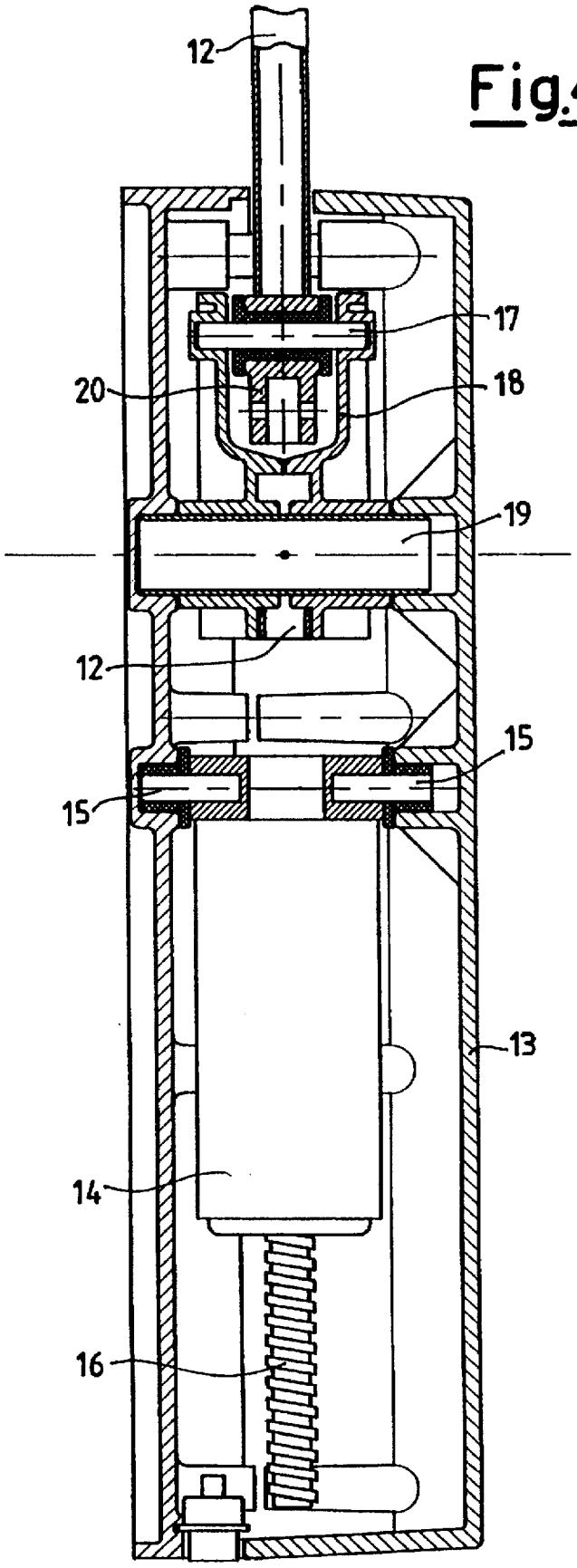
FIG. 4 shows a sectional view of the motor unit.

Referring to FIGS. 2–4 of the accompanying drawings, said motor unit comprises a ratiomotor (14) hinged onto the case (13) by means of a pivot (15), which ratiomotor 14, through a feed nut, drives a screw (16) to translate. Said screw (16) has a terminal head (20) hinged, through a pivot (17), onto a bracket (18); in its turn, said bracket (18) is hinged, through a pivot (19), onto the case (13).

The lever (12) is constrained to said bracket (18).

From the above disclosure, it clearly appears that when the ratiomotors (14) are actuated in either direction, they will cause the screws (16) to translate from their position as shown in FIG. 2, to their position shown in FIG. 3, with the ratiomotors (14) and the brackets (18) consequently rotating around the pivots (15) and (19), respectively, with the levers (12) being consequently lowered and raised, respectively, to bring the clothes to their low or high positions, as desired by the operator.

The ratiomotor unit can also be actuated through remote control means, which is a very useful, and sometimes may also be an essential, feature, for example in the case of disabled persons.

It should be observed that in case of motor stopping, thanks to the irreversibility of the feed nut-screw mechanism, the stable positioning is secured of the clothes-hanger tube means (11) at any level.

In FIG. 1, the reference numeral (21) indicates the case containing all electrical and electronic components of ratiomotor unit (14) control means.

The innovation according to the present invention can also be applied to clothes-hanger devices of the type with upwards/downwards moving elevator means equipped with one single central lever bearing, at its free end, a horizontal (clothes-hanger) tube means, or not equipped with said tube means, but provided with clothes-supporting hooks along it.

The latter embodiment is clearly displayed in FIGS. 5–11 of the accompanying drawings.

Referring to said figures, a metal lever (22), preferably coated with a shape of plastic material (23) (FIG. 7), e.g., spring-like applied onto it, and provided with a nose (24) at its free end, bears a plurality of clothes-hanger rings (25).

Figure 5:
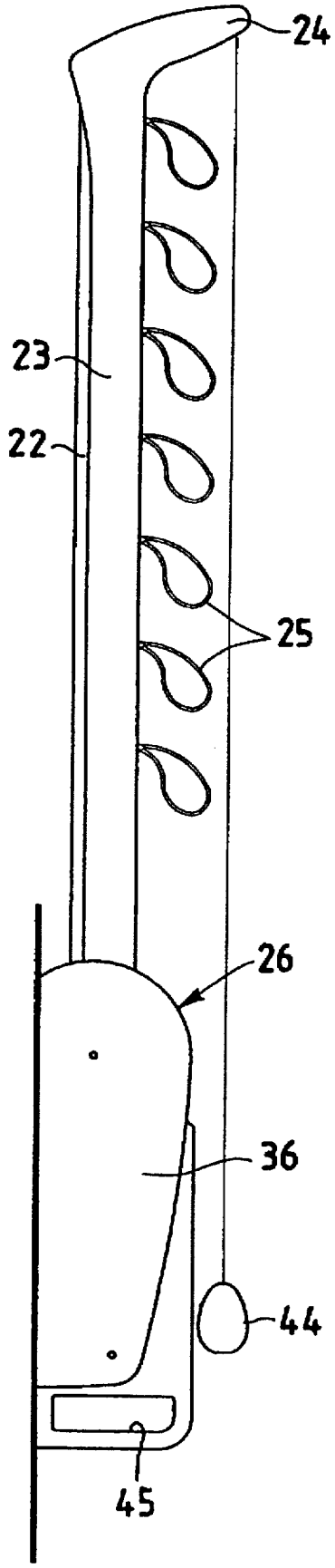
FIG. 5 shows a further embodiment of the device according to the present invention, in which the single clothes-hanger lever is in its raised position.
Figure 6:
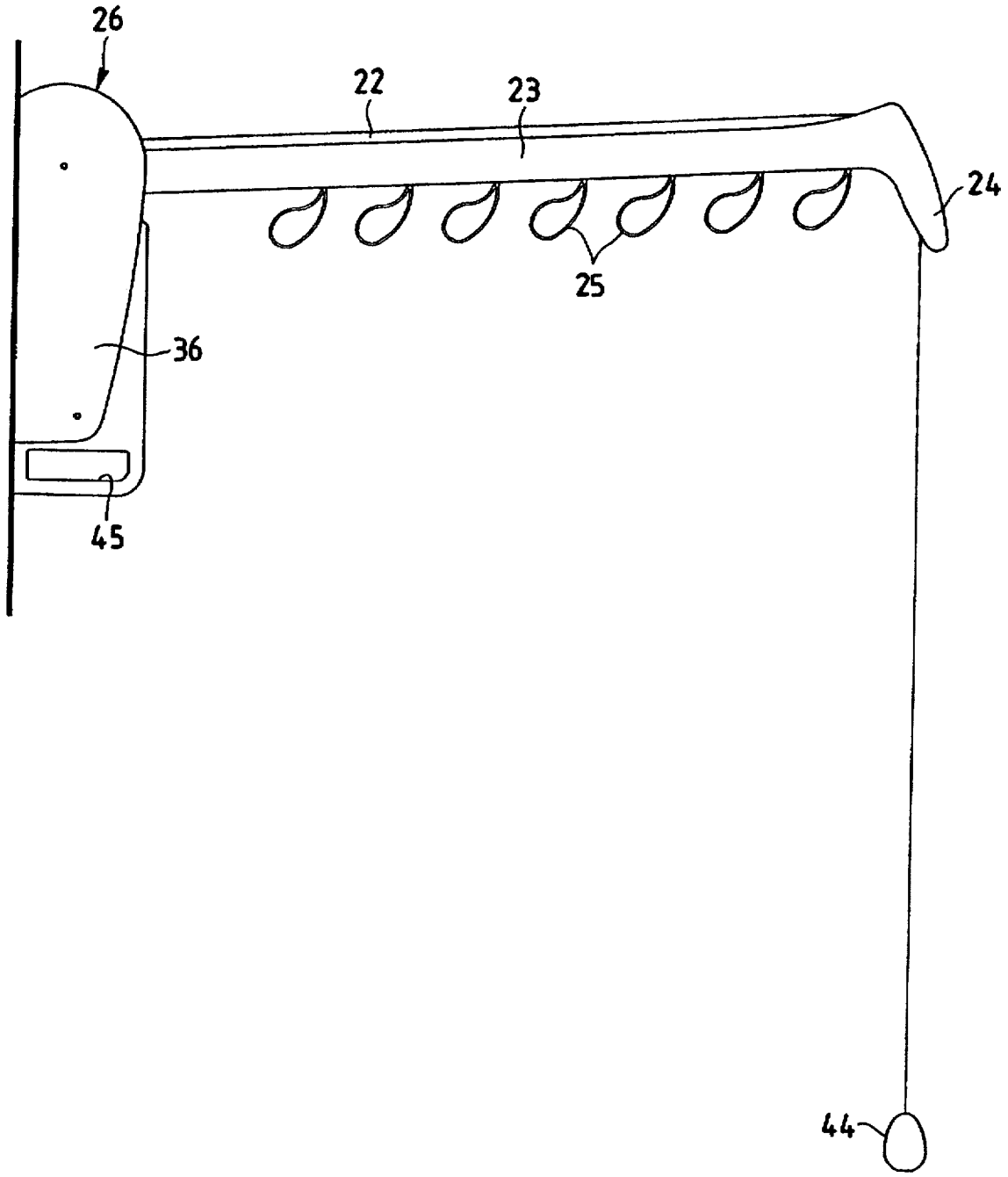
FIG. 6 shows a view of the same device as of FIG. 5, in which said lever is in its lowered position.
Figure 8:
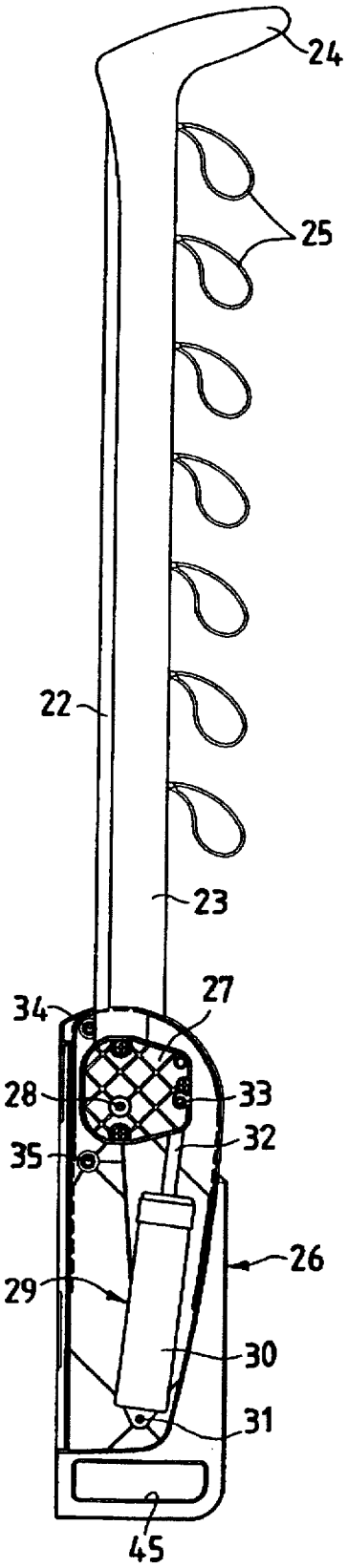
FIG. 8 shows a view of the device of FIG. 7, in its assembled condition.
Figure 7:
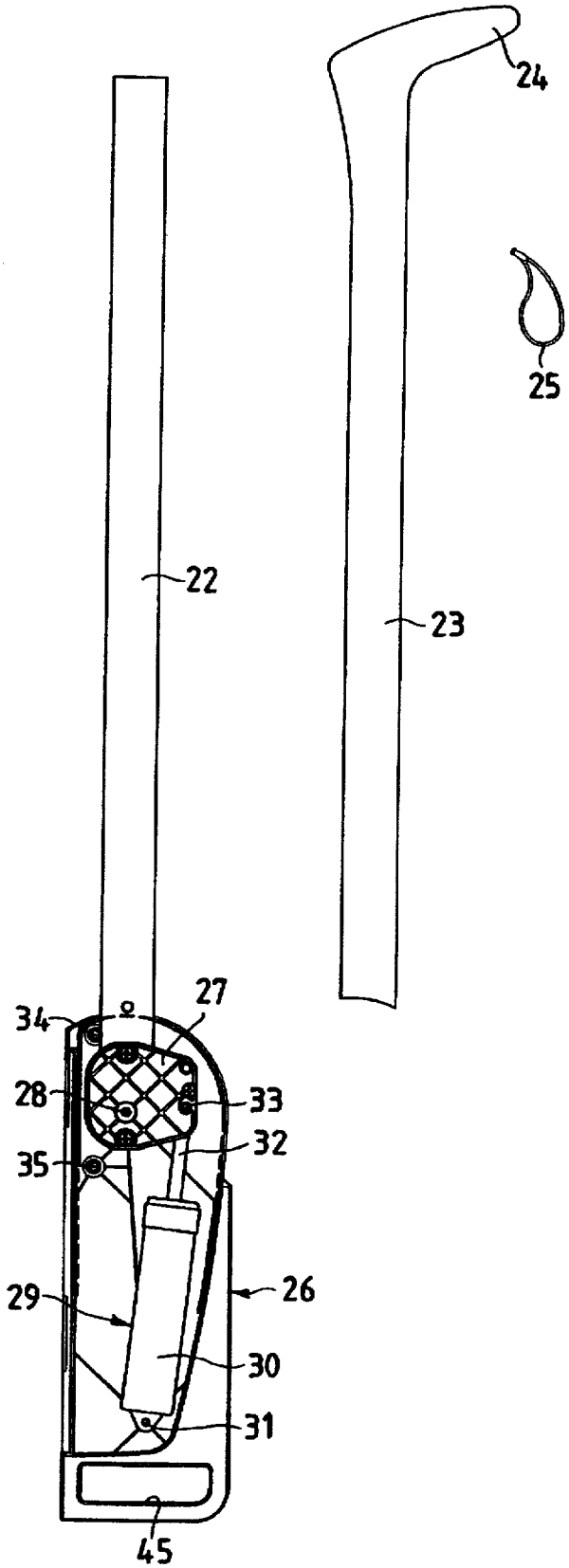
FIG. 7 shows an exploded view of the device of FIGS. 5, 6, with the carrier case being open.

The metal lever (22) is hinged inside the interior chamber of a case (26) designed to be fastened onto a wall, and is movable between the raised position of FIG. 5 and the lowered position of FIG. 6. In this position, any clothes hanging from rings (25) are at man-height level.

More precisely, the lever (22) is integrally clamped and fastened between two plates (27) hinged in (28) onto the opposite walls of the case (26) (FIGS. 7–10).

With (29), a drive unit, e.g., of fluid-dynamic type, is generally schematized, which is suitable for driving the movement of the lever (22) between both above said raised and lowered positions.

For that purpose, the body (30) of the drive unit (29) is hinged in (31) to the case (26) and the drive stem (32) is hinged in (33) to the plates (27).

Two stroke limit means (34, 35) provided inside the case (26) define the stroke end positions of the lever (22), in said lever raised and lowered positions, respectively.

Figure 9:
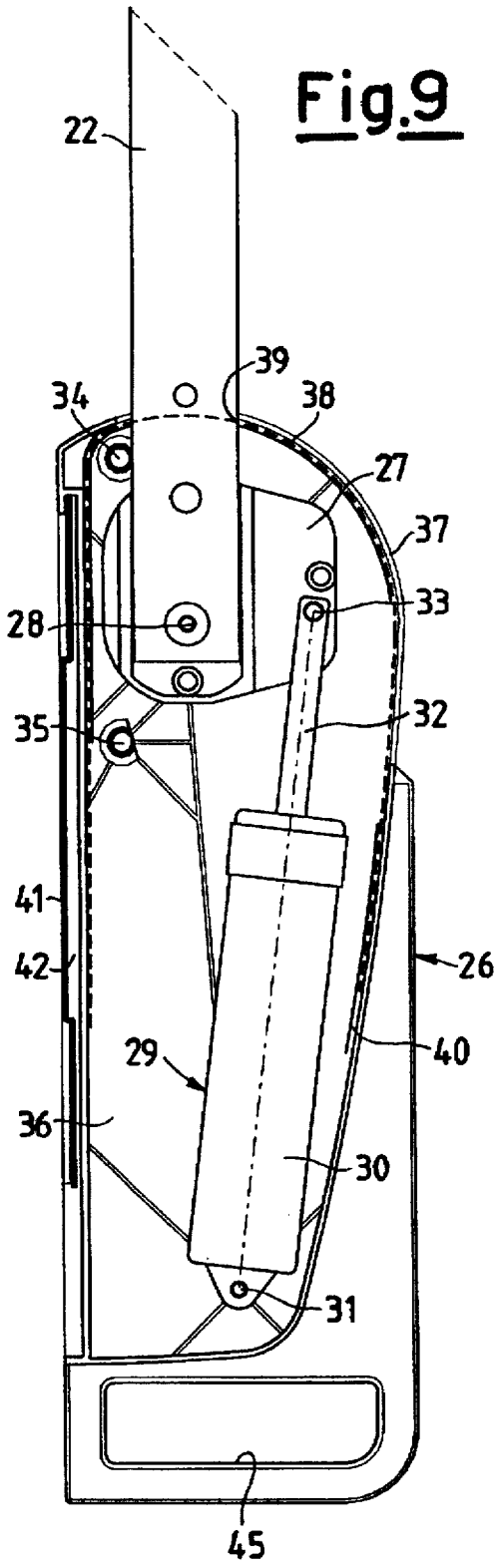
FIG. 9 shows an enlarged view illustrating the case of the device in its open condition, with the drive mechanism being in its condition corresponding to the clothes-hanger lever being lifted.
Figure 10:
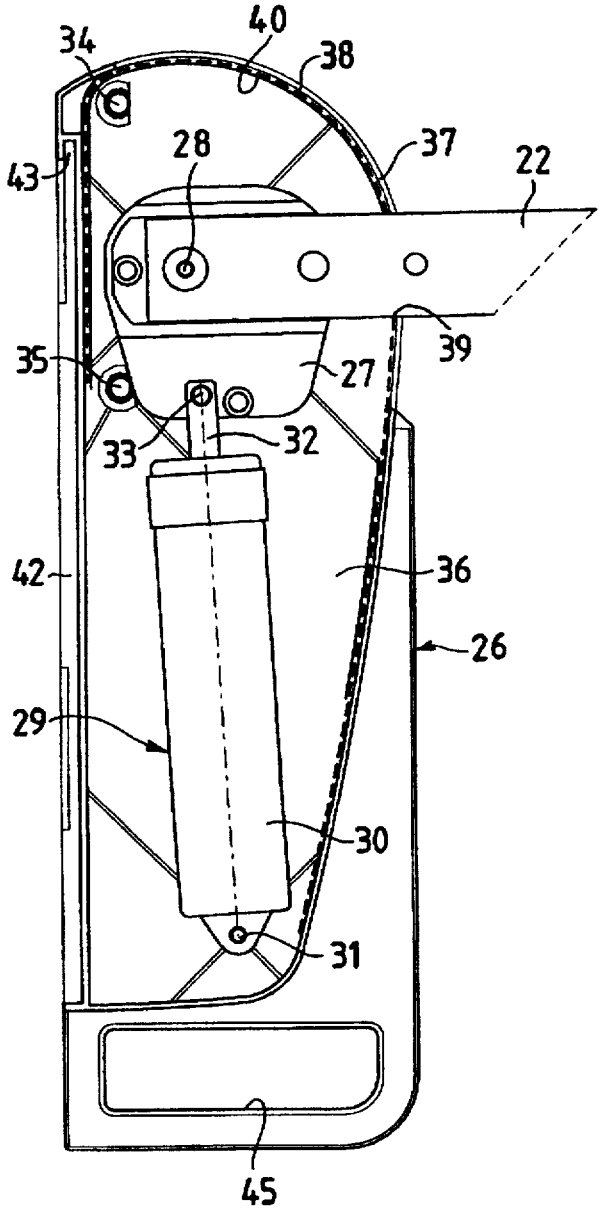
FIG. 10 shows a similar view to FIG. 9, with the drive mechanism being in its condition corresponding to the clothes-hanger lever being lowered.

For that purpose, the stroke end means (34) cooperates with the lever (22) and the stroke end means 35 cooperates with the plates (27) (FIGS. 9, 10).

Figure 11:
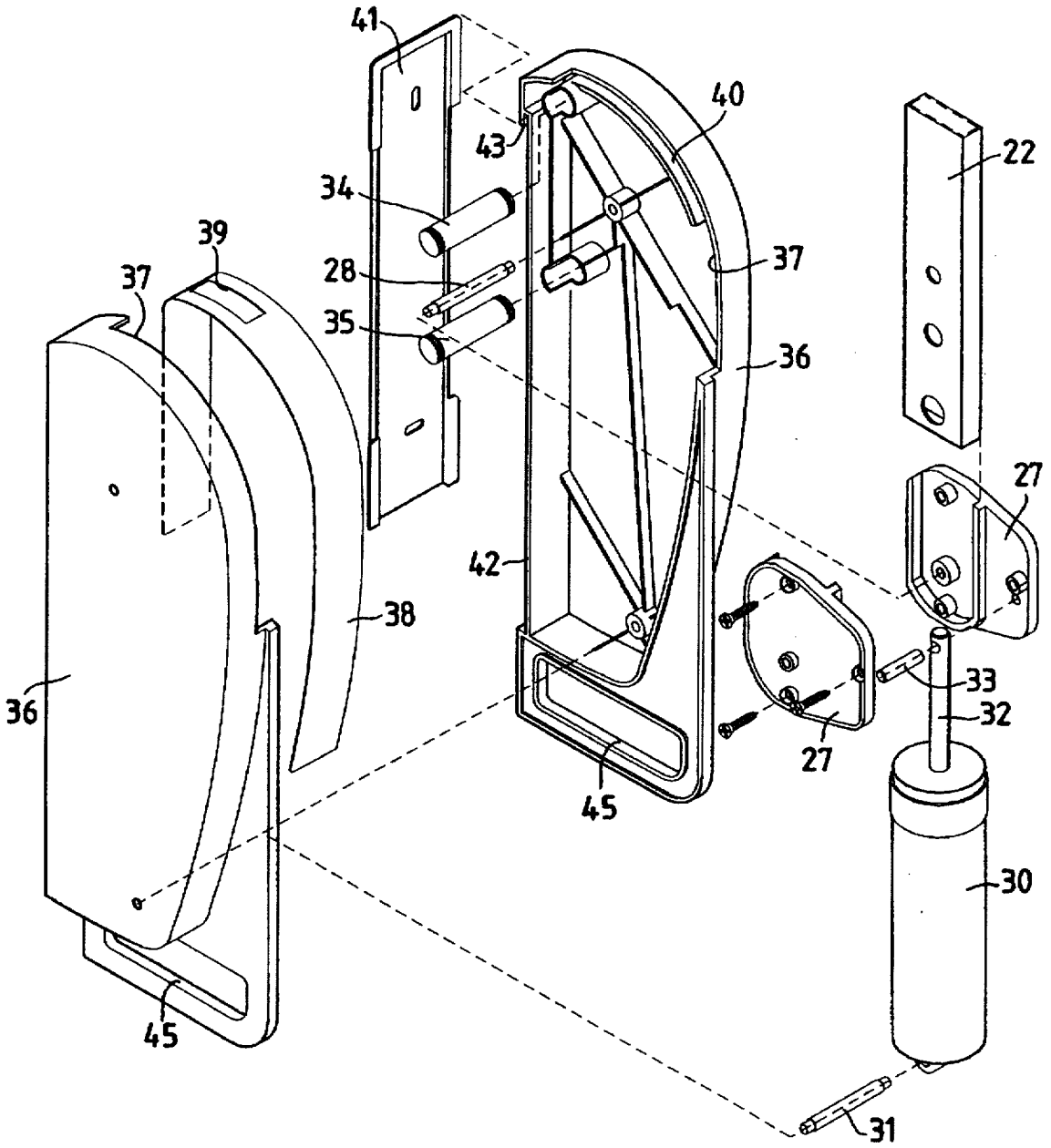
FIG. 11 shows an exploded perspective view of the case of the clothes-hanger lever support, containing the drive mechanism.

As one will clearly see from FIG. 11 of the drawings, the case (26) is constituted by two half-cases (36), which are mutually coupled and stably fastened to each other, e.g., by means of coupling studs and/or other equivalent fastening means; for that purpose, the stroke end means (34, 35) are used as well.

In order to enable the lever (22) to rotate around its hinge pivot (28), both half-cases (36) are shaped in such a way as to define, when they are mutually coupled to form the case (26), an arcuate window (37).

In a characteristic way, said arcuate window (37), for safety purposes and in order to prevent dust from entering the inner chamber of the case, is closed by means of a ribbon (38) of a flexible material (e.g., plastic material) constrained to the lever (22) which extends through an opening (39) provided in said ribbon (38). Said ribbon can furthermore slide inside a seat (40) purposely provided inside said case (26).

In that way, by rotating between its raised and lowered positions as shown in FIGS. 9, 10, the lever (22) drags with itself the ribbon (38) which hides the window (37).

With (41) a metal plate is indicated which is designed to be fastened to a supporting wall, and onto which the case (26) is applied which, for that purpose, is provided, on its rear side, with a seat (42) designed to get coupled, by getting hooked in (43), with said plate (41).

With (44) an actuation cord is indicated which can possibly be used in order to manually actuate the device, should the fluid-dynamic drive unit misfunction and/or be disabled.

With (45) a ring-shaped handle is indicated which can be used both to hang, e.g., heavy-weight articles, like bags and the like, and to comfortably transport the packaged device.

The purpose mentioned in the preamble to the disclosure is thus accomplished.

I claim:

1. Clothes-hanger device of the type with upwards/downwards moving elevator means comprising carrier means (11) designed to receive the hung clothes, which carrier means are applied to at least one lever (12) extending from a linkage mechanism means contained inside at least one case (13) fastened onto a carrier surface, characterized in that to said at least one lever (12) a motor unit is applied which is capable of driving said lever (12) in order to cause said lever to move from a substantially vertical raised position, to a substantially horizontal lowered position.

2. Device according to claim 1, characterized in that said motor unit is constituted by a ratiomotor unit (14) hinged in (15) onto the case (13) and that through at least one feed nut causes a screw (16) to translate, with said screw (16) being operatively linked with said at least one lever (12) through said linkage mechanism means.

3. Device according to claim 2, characterized in that said linkage mechanism means comprises a bracket (18) fastened to said at least one lever (12) and hinged through a pivot (19) onto said case (13), with the head (20) of said screw (16) being in its turn hinged onto said bracket (18) through a pivot (17).

4. Device according to claim 1, characterized in that it comprises a horizontal tube means (11) applied onto two side levers (12).

5. Device according to claim 1, characterized in that it comprises a horizontal tube means (11) applied onto the free end of one single lever (12) only.

6. Device according to claim 1, characterized in that it comprises one single lever (22) having support means (25) designed to receive the hung clothes.

7. Device according to claim 6, characterized in that said lever (22) is coated by a shape of plastic material (23).

8. Device according to claim 6, characterized in that said lever (22) is integrally clamped and fastened between two plates (27) hinged in (28) onto a carrier case (26) containing a drive mechanism means.

9. Device according to claim 8, characterized in that said drive mechanism means comprises a fluid-dynamic unit (29) having a body (30) hinged in (31) onto the case (26) and a drive stem (32) hinged in (33) onto said plates (27).

10. Device according to claim 8, characterized in that inside the case (26) two stroke limit means (34, 35) are provided which define the stroke end positions of the lever (22) in its raised and lowered positions, respectively, with said stroke limit means (34) cooperating with said lever (22), and said stroke limit means (35) cooperating with said plates (27).

11. Device according to claim 8, characterized in that said case (26) is constituted by two half-cases (36) stably coupled with each other.

12. Device according to claim 11, characterized in that both said half-cases (36) are so shaped as to define, when they are mutually coupled to form the case (26), an arcuate window (37) along which the lever (22) rotates, with said arcuate window (37) being closed by means of a ribbon (38) of a flexible material constrained to said lever (22) and sliding inside a seat (40) provided inside said case (26).

13. Device according to claim 8, characterized in that it comprises a plate (41) designed to be fastened onto a carrier wall, on which plate (41) said case (26) is fastened which, for that purpose, is provided with a rear seat (42) which gets coupled with said plate (41) by getting hooked onto it at (43)

14. Device according to claim 6, characterized in that said Lever (22) is provided, at its free end, with an actuation cord (44).

15. Device according to claim 8, characterized in that said case (26) is provided with a ring-shaped handle (45).

* * * * *